US006722943B2

(12) United States Patent
Joslyn

(10) Patent No.: US 6,722,943 B2
(45) Date of Patent: Apr. 20, 2004

(54) PLANARIZING MACHINES AND METHODS FOR DISPENSING PLANARIZING SOLUTIONS IN THE PROCESSING OF MICROELECTRONIC WORKPIECES

(75) Inventor: Michael J. Joslyn, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 77 days.

(21) Appl. No.: 09/939,430

(22) Filed: Aug. 24, 2001

(65) Prior Publication Data

US 2003/0143927 A1 Jul. 31, 2003

(51) Int. Cl.[7] ..... B24B 49/00

(52) U.S. Cl. ..... 451/5; 451/8; 451/41; 451/60; 451/287; 451/443; 451/444

(58) Field of Search ..... 451/41, 285–289, 451/60, 443, 444, 5, 8

(56) References Cited

U.S. PATENT DOCUMENTS

| | | | |
|---|---|---|---|
| 5,069,002 | A | 12/1991 | Sandhu et al. |
| 5,081,796 | A | 1/1992 | Schultz |
| 5,209,816 | A | 5/1993 | Yu et al. |
| 5,225,034 | A | 7/1993 | Yu et al. |
| 5,232,875 | A | 8/1993 | Tuttle et al. |
| 5,234,867 | A | 8/1993 | Schultz et al. |
| 5,240,552 | A | 8/1993 | Yu et al. |
| 5,244,534 | A | 9/1993 | Yu et al. |
| 5,245,790 | A | 9/1993 | Jerbic |
| 5,245,796 | A | 9/1993 | Miller et al. |
| RE34,425 | E | 11/1993 | Schultz |
| 5,354,490 | A | 10/1994 | Yu et al. |
| 5,421,769 | A | 6/1995 | Schultz et al. |
| 5,433,651 | A | 7/1995 | Lustig et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,533,924 | A | 7/1996 | Stroupe et al. |
| 5,540,810 | A | 7/1996 | Sandhu et al. |
| 5,616,069 | A | 4/1997 | Walker et al. |
| 5,618,381 | A | 4/1997 | Doan et al. |
| 5,643,060 | A | 7/1997 | Sandhu et al. |
| 5,645,682 | A | 7/1997 | Skrovan |

(List continued on next page.)

OTHER PUBLICATIONS

Kondo, S. et al., "Abrasive–Free Polishing for Copper Damascene Interconnection," Journal of The Electrochemical Sociey, vol. 147, No. 10, pp. 3907–3913, 2000, The Electrochemical Society, Inc.

*Primary Examiner*—M. Rachuba
(74) *Attorney, Agent, or Firm*—Perkins Coie LLP

(57) ABSTRACT

Machines with solution dispensers and methods of using such machines for chemical-mechanical planarization and/or electrochemical-mechanical planarization/deposition of microelectronic workpieces. One embodiment of such a machine includes a table having a support surface, a processing pad on the support surface, and a carrier assembly having a head configured to hold a microelectronic workpiece. The carrier assembly can further include a drive assembly that manipulates the head. The machine can also include a solution dispenser separate from the head. The solution dispenser can include a support extending over the pad and a fluid discharge unit or distributor carried by the support. The fluid discharge unit is configured to discharge a planarizing solution onto a plurality of separate locations across the pad.

26 Claims, 10 Drawing Sheets

U.S. PATENT DOCUMENTS 5,655,951 A 8/1997 Meikle et al.
5,658,183 A 8/1997 Sandhu et al.
5,658,190 A 8/1997 Wright et al.
5,664,988 A 9/1997 Stroupe et al.
5,679,065 A 10/1997 Henderson
5,702,292 A 12/1997 Brunelli et al.
5,725,417 A 3/1998 Robinson
5,730,642 A 3/1998 Sandhu et al.
5,747,386 A 5/1998 Moore
5,779,522 A 7/1998 Walker et al.
5,782,675 A 7/1998 Southwick
5,792,709 A 8/1998 Robinson et al.
5,795,495 A 8/1998 Meikle
5,801,066 A 9/1998 Meikle
5,807,165 A 9/1998 Uzoh et al.
5,827,781 A 10/1998 Skrovan et al.
5,830,806 A 11/1998 Hudson et al.
5,833,519 A 11/1998 Moore
5,846,336 A 12/1998 Skrovan
5,851,135 A 12/1998 Sandhu et al.
5,868,896 A 2/1999 Robinson et al.
5,879,226 A 3/1999 Robinson
5,882,248 A 3/1999 Wright et al.
5,893,754 A 4/1999 Robinson et al.
5,895,550 A 4/1999 Andeas
5,910,043 A 6/1999 Manzonie et al.
5,916,819 A 6/1999 Skrovan et al.
5,930,699 A 7/1999 Bhatia
5,934,980 A 8/1999 Koos et al.
5,945,347 A 8/1999 Wright
5,954,912 A 9/1999 Moore
5,967,030 A 10/1999 Blalock
5,972,792 A 10/1999 Hudson
5,975,994 A 11/1999 Sandhu et al.
5,980,363 A 11/1999 Meikle et al.
5,981,396 A 11/1999 Robinson et al.
5,990,012 A 11/1999 Robinson et al.
5,994,224 A 11/1999 Sandhu et al.
5,997,384 A 12/1999 Blalock
5,997,392 A * 12/1999 Chamberlin et al. ..... 451/446
6,004,196 A 12/1999 Doan et al.
6,039,633 A 3/2000 Chopra
6,040,245 A 3/2000 Sandhu et al.
6,053,801 A * 4/2000 Pinson et al. ..... 451/56
6,054,015 A 4/2000 Brunelli et al.
6,060,395 A 5/2000 Skrovan et al.
6,066,030 A 5/2000 Uzoh
6,074,286 A 6/2000 Ball
6,077,785 A 6/2000 Andreas
6,083,085 A 7/2000 Lankford
6,110,820 A 8/2000 Sandhu et al.
6,116,988 A 9/2000 Ball
6,120,354 A 9/2000 Koos et al.
6,124,207 A 9/2000 Robinson et al.
6,135,856 A 10/2000 Tjaden et al.
6,136,218 A 10/2000 Skrovan et al.
6,139,402 A 10/2000 Moore
6,139,406 A * 10/2000 Kennedy et al. ..... 451/67
6,143,123 A 11/2000 Robinson et al.
6,143,155 A 11/2000 Adams et al.
6,152,808 A 11/2000 Moore
6,176,763 B1 1/2001 Kramer et al.
6,176,992 B1 1/2001 Talieh
6,180,525 B1 1/2001 Morgan
6,187,681 B1 2/2001 Moore
6,191,037 B1 2/2001 Robinson et al.
6,193,588 B1 2/2001 Carlson et al.
6,196,899 B1 3/2001 Chopra et al.
6,200,901 B1 3/2001 Hudson et al.
6,203,404 B1 3/2001 Joslyn et al.
6,203,413 B1 3/2001 Skrovan
6,206,756 B1 3/2001 Chopra et al.
6,206,757 B1 3/2001 Custer et al.
6,210,257 B1 4/2001 Carlson
6,213,845 B1 4/2001 Elledge
6,218,316 B1 4/2001 Marsh
6,220,934 B1 4/2001 Sharples et al.
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,238,270 B1 5/2001 Robinson
6,250,994 B1 6/2001 Chopra et al.
6,251,785 B1 6/2001 Wright
6,261,151 B1 7/2001 Sandhu et al.
6,261,163 B1 7/2001 Walker et al.
6,267,650 B1 7/2001 Hembree
6,271,139 B1 8/2001 Alwan et al.
6,273,786 B1 8/2001 Chopra et al.
6,273,796 B1 8/2001 Moore
6,273,800 B1 8/2001 Walker et al.
6,276,996 B1 8/2001 Chopra
6,280,299 B1 * 8/2001 Kennedy et al. ..... 451/67
6,284,092 B1 * 9/2001 Manfredi ..... 156/345.12
6,284,660 B1 9/2001 Doan
6,306,008 B1 10/2001 Moore
6,306,012 B1 10/2001 Sabde
6,306,014 B1 10/2001 Walker et al.
6,306,768 B1 10/2001 Klein
6,312,486 B1 11/2001 Sandhu et al.
6,312,558 B2 11/2001 Moore
6,313,038 B1 11/2001 Chopra et al.
6,328,632 B1 12/2001 Chopra
6,331,139 B2 12/2001 Walker et al.
6,331,488 B1 12/2001 Doan et al.
6,350,180 B2 2/2002 Southwick
6,350,691 B1 2/2002 Lankford
6,352,466 B1 3/2002 Moore
6,352,470 B2 3/2002 Elledge
6,354,917 B1 3/2002 Ball
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,411 B1 3/2002 Chopra et al.
6,361,413 B1 3/2002 Skrovan
6,361,417 B2 3/2002 Walker et al.
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,375,548 B1 4/2002 Andreas
6,376,381 B1 4/2002 Sabde
6,398,627 B1 * 6/2002 Chiou et al. ..... 451/72
2002/0022440 A1 * 2/2002 Kunugi ..... 451/60

* cited by examiner

PLANARIZING MACHINES AND METHODS FOR DISPENSING PLANARIZING SOLUTIONS IN THE PROCESSING OF MICROELECTRONIC WORKPIECES

TECHNICAL FIELD

The present invention relates to planarizing machines and methods for dispensing planarizing solutions onto a plurality of locations of a processing pad in the fabrication of microelectronic devices.

BACKGROUND

Mechanical and chemical-mechanical planarizing processes (collectively "CMP") remove material from the surface of semiconductor wafers, field emission displays, read/write heads or other microelectronic workpieces in the production of microelectronic devices and other products. FIG. 1 schematically illustrates a CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a workpiece 12 may be attached, or the workpiece 12 may be attached to a resilient pad 34 in the head 32. The head 32 may be a free-floating wafer carrier, or an actuator assembly 36 may be coupled to the head 32 to impart axial and/or rotational motion to the workpiece 12 (indicated by arrows H and I, respectively).

The planarizing pad 40 and a planarizing solution 44 on the pad 40 collectively define a planarizing medium that mechanically and/or chemically-mechanically removes material from the surface of the workpiece 12. The planarizing pad 40 can be a soft pad or a hard pad. The planarizing pad 40 can also be a fixed-abrasive planarizing pad in which abrasive particles are fixedly bonded to a suspension material. In fixed-abrasive applications, the planarizing solution 44 is typically a non-abrasive "clean solution" without abrasive particles. In other applications, the planarizing pad 40 can be a non-abrasive pad composed of a polymeric material (e.g., polyurethane), resin, felt or other suitable materials. The planarizing solutions 44 used with the non-abrasive planarizing pads are typically abrasive slurries with abrasive particles suspended in a liquid.

To planarize the workpiece 12 with the CMP machine 10, the carrier assembly 30 presses the workpiece 12 face-downward against the polishing medium. More specifically, the carrier assembly 30 generally presses the workpiece 12 against the planarizing liquid 44 on a planarizing surface 42 of the planarizing pad 40, and the platen 20 and/or the carrier assembly 30 move to rub the workpiece 12 against the planarizing surface 42. As the workpiece 12 rubs against the planarizing surface 42, material is removed from the face of the workpiece 12.

CMP processes should consistently and accurately produce a uniformly planar surface on the workpiece to enable precise fabrication of circuits and photo-patterns. During the construction of transistors, contacts, interconnects and other features, many workpieces develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a workpiece.

In the highly competitive semiconductor industry, it is also desirable to maximize the throughput of CMP processing by producing a planar surface on a workpiece as quickly as possible. The throughput of CMP processing is a function, at least in part, of the polishing rate of the planarizing cycle and the ability to accurately stop CMP processing at a desired endpoint. Therefore, it is generally desirable for CMP processes to provide (a) a desired polishing rate gradient across the face of a substrate to enhance the planarity of the finished surface, and (b) a reasonably consistent polishing rate during a planarizing cycle to enhance the accuracy of determining the endpoint of a planarizing cycle.

Conventional planarizing machines may not provide consistent polishing rates because of nonuniformities in (a) the distribution of the slurry across the processing pad, (b) the wear of the processing pad, and/or (c) the temperature of the processing pad. The distribution of the planarizing solution across the surface of the processing pad may not be uniform because conventional planarizing machines typically discharge the planarizing solution onto a single point at the center of the pad. This causes a thicker layer of planarizing solution the center of the pad than at the perimeter, which may result in different polishing rates across the pad. Additionally, the nonuniform distribution of the planarizing solution may cause the center region of the pad to behave differently than the perimeter region because many low PH solutions used during planarizing cycles are similar to cleaning solutions for removing stains and waste matter from the pads when polishing metallic surfaces. Such low PH planarizing solutions dispersed locally accordingly may change the physical characteristics differently at the center of the pad than at the perimeter. The nonuniform distribution of planarizing solution also causes a nonuniform temperature distribution across the pad because the planarizing solution is typically at a different temperature than the processing pads. For example, when the planarizing solution is at a lower temperature than the pad, the temperature near the single dispensing point of the planarizing solution is typically lower than other areas of the processing pad.

One concern of manufacturing microelectronic workpieces is that the distribution of the planarizing solution can cause variances in the planarized surface of the workpieces. For example, an inconsistent distribution of planarizing solution between the workpiece and the pad can cause certain areas of the workpiece to planarize faster than other areas. Nonuniform pad wear and nonuniform temperature distributions across the processing pad can also cause inconsistent planarizing results that (a) reduce the planarity and uniformity of the planarized surface on the workpieces, and (b) reduce the accuracy of endpointing the planarizing cycles. Therefore, it would be desirable to develop more consistent planarizing procedures and machines to provide more accurate planarization of microelectronic workpieces.

SUMMARY OF THE INVENTION

The present invention describes machines with solution dispensers for use in chemical-mechanical planarization and/or electrochemical-mechanical planarization/deposition of microelectronic workpieces. One embodiment of such a machine includes a table having a support surface, a processing pad on the support surface, and a carrier assembly having a head configured to hold a microelectronic workpiece. The carrier assembly can further include a drive assembly that carries the head. The machine can also include a solution dispenser separate from the head. The solution dispenser can include a support extending over the pad and a fluid discharge unit or distributor carried by the support. The fluid discharge unit is configured to simultaneously discharge a planarizing solution onto a plurality of separate locations across the pad.

In one particular embodiment, the solution dispenser comprises an elongated support extending over the pad at a location spaced apart from a travel path of the head, a fluid passageway carried by the support through which the planarizing solution can flow, and a plurality of nozzles carried by the support. The nozzles are in fluid communication with the fluid passageway to create a plurality of flows of planarizing solution that are discharged onto separate locations across the processing pad. An alternate embodiment of a machine in accordance with the invention includes a solution dispenser comprising an elongated support extending over the pad at a location spaced apart from the travel path of the head, a fluid passageway carried by the support through which a planarizing solution can flow, and an elongated slot extending along at least a portion of the support. The elongated slot is in fluid communication with the fluid passageway to create an elongated flow of planarizing solution. Another alternative embodiment includes an elongated support having a channel extending along at least a portion of the support through which the planarizing solution can flow and a lip along at least a portion of the channel over which the planarizing solution can flow. The lip accordingly defines a weir for depositing an elongated flow of planarizing solution across a portion of the pad.

Other embodiments of solution dispensers for the planarizing machine comprise an elongated support extending over the pad at a location spaced apart from the travel path of the head, a fluid passageway carried by support, a first fluid discharge unit, and a second fluid discharge unit. The elongated support of these embodiments can include a first section and a second section. The first fluid discharge unit can be carried at the first section of the support to discharge a first flow of the planarizing solution onto a first location of the pad. The second fluid discharge unit can be carried by the second section of the support to discharge a second flow of the planarizing solution onto a second location of the pad. The first and second fluid discharge units can be independently controllable from one another so that the first flow of planarizing solution discharged onto the first location of the pad is different than the second flow of planarizing solution discharged onto the second location of the pad.

DETAILED DESCRIPTION

The following disclosure describes planarizing machines with planarizing solution dispensers and methods for planarizing microelectronic workpieces. The microelectronic workpieces can be semiconductor wafers, field emission displays, read/write media, and many other workpieces that have microelectronic devices with miniature components (e.g., integrated circuits). Many of the details of the invention are described below with reference to rotary planarizing applications to provide a thorough understanding of such embodiments. The present invention, however, can also be practiced using web-format planarizing machines and electrochemical-mechanical planarizing/deposition machines. Suitable web-format planarizing machines that can be adapted for use with the present invention include U.S. patent application Ser. Nos. 09/595,727 and 09/565,639, which are herein incorporated by reference. A suitable electrochemical-mechanical planarizing/deposition machine that can be adapted for use is shown in U.S. Pat. No. 6,176,992, which is also herein incorporated by reference. A person skilled in the art will thus understand that the invention may have additional embodiments, or that the invention may be practiced without several of the details described below.

Figure 1:
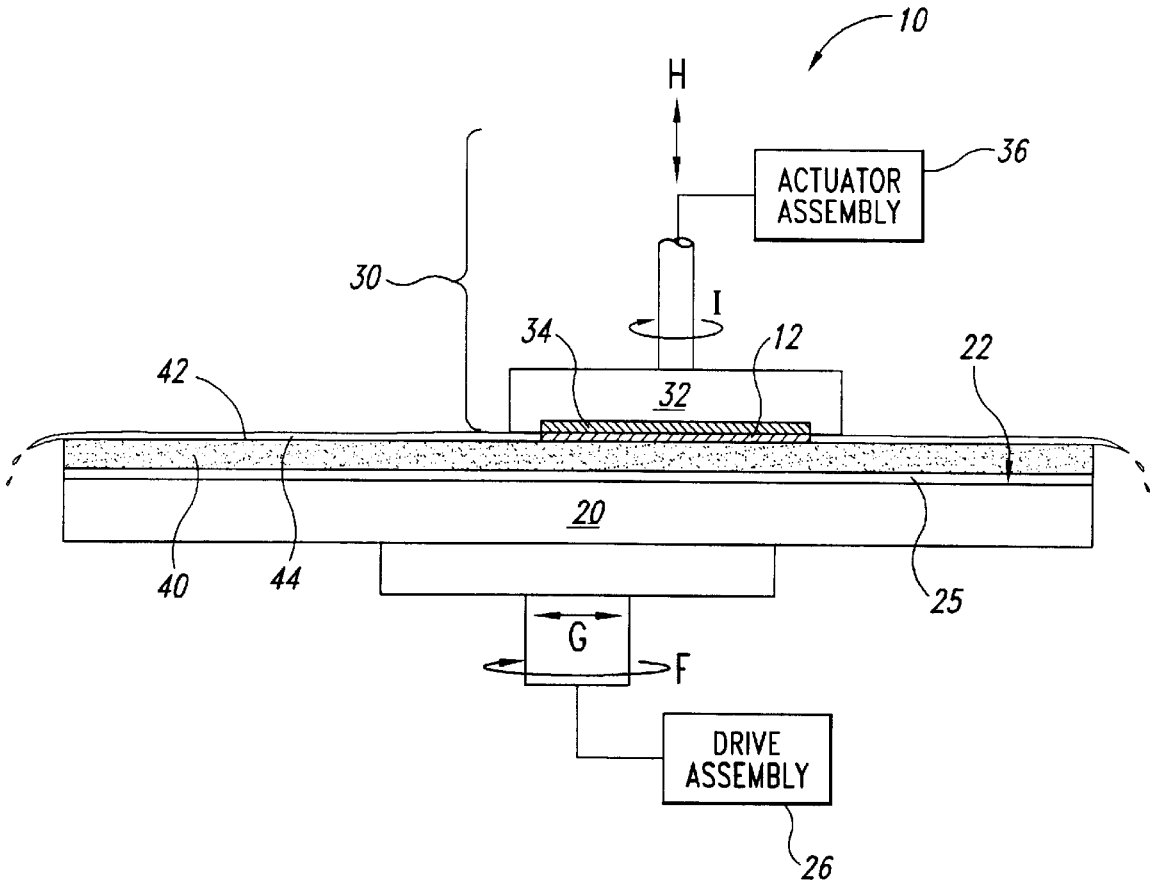
Fig. 1 (Prior Art)
FIG. 1 is a cross-sectional view of a planarizing machine in accordance with the prior art in which selected components are shown schematically.
Figure 2:
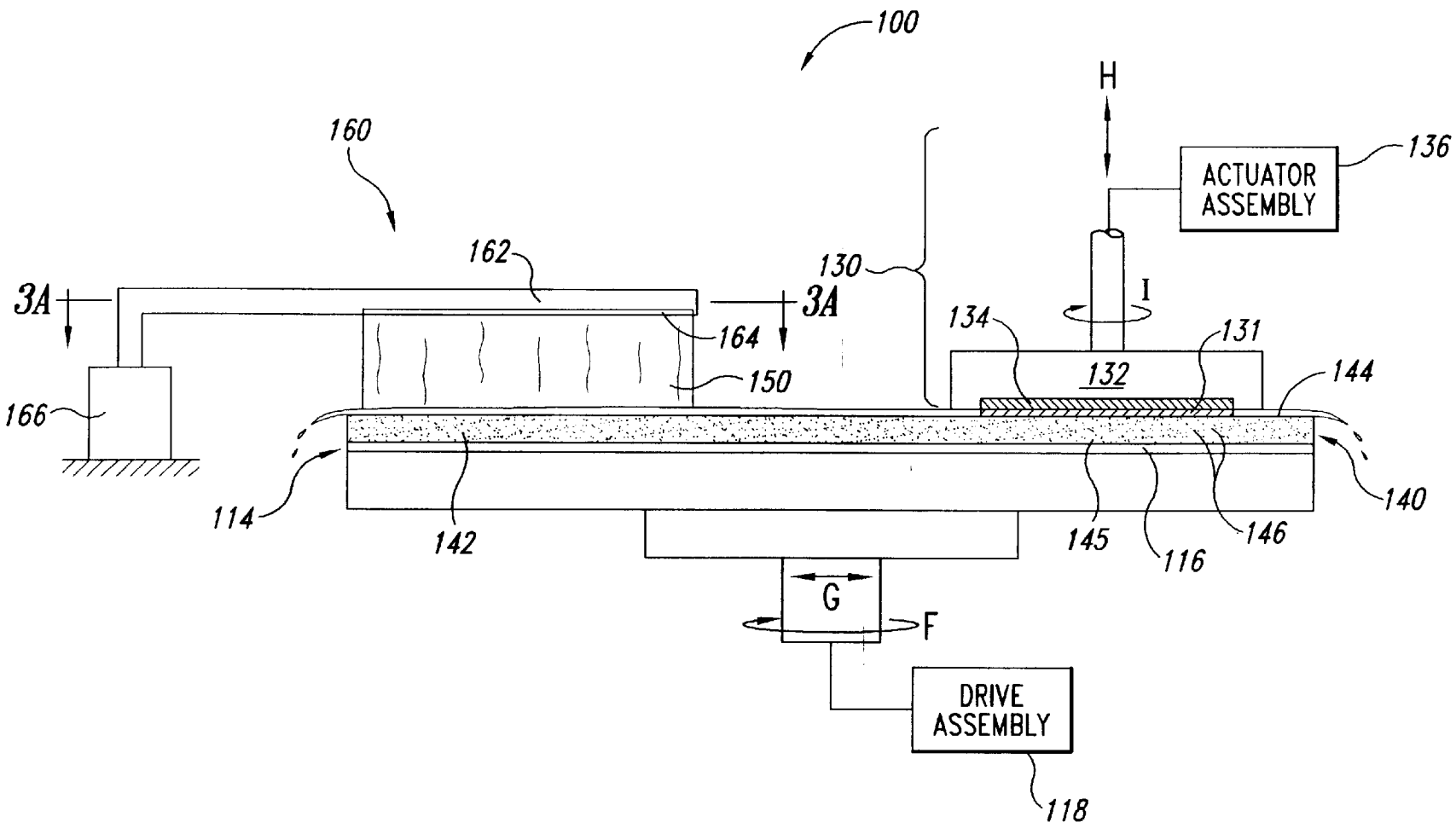
FIG. 2 is a side elevation view of a planarizing system including a planarizing solution dispenser in accordance with an embodiment of the invention with selected components shown in cross-section or schematically.

FIG. 2 is a cross-sectional view of a planarizing system 100 having a planarizing solution dispenser 160 that discharges a planarizing solution 150 in accordance with an embodiment of the invention. The planarizing machine 100 has a table 114 with a top panel 116. The top panel 116 is generally a rigid plate to provide a flat, solid surface for supporting a processing pad. In this embodiment, the table 114 is a rotating platen that is driven by a drive assembly 118.

The planarizing machine 100 also includes a workpiece carrier assembly 130 that controls and protects a microelectronic workpiece 131 during planarization or electrochemical-mechanical planarization/deposition processes. The carrier assembly 130 can include a workpiece holder 132 to pick up, hold and release the workpiece 131 at appropriate stages of a planarizing cycle and/or a conditioning cycle. The workpiece carrier assembly 130 also generally has a backing member 134 contacting the backside of the workpiece 131 and an actuator assembly 136 coupled to the workpiece holder 132. The actuator assembly 136 can move the workpiece holder 132 vertically (arrow H), rotate the workpiece holder 132 (arrow I), and/or translate the workpiece holder 132 laterally. In a typical operation, the actuator assembly 136 moves the workpiece holder 132 to press the workpiece 131 against a processing pad 140.

The processing pad 140 shown in FIG. 2 has a planarizing medium 142 and a contact surface 144 for selectively removing material from the surface of the workpiece 131. The planarizing medium 142 can have a binder 145 and a plurality of abrasive particles 146 distributed throughout at least a portion of the binder 145. The binder 145 is generally a resin or another suitable material, and the abrasive particles 146 are generally alumina, ceria, titania, silica or other suitable abrasive particles. At least some of the abrasive particles 146 are partially exposed at the contact surface 144 of the processing pad 140. Suitable fixed-abrasive planarizing pads are disclosed in U.S. Pat. Nos. 5,645,471; 5,879,222; 5,624,308; and U.S. patent application Ser. Nos. 09-164,916 and 09-001,333, all of which are herein incorporated by reference. In other embodiments the processing pad 140 can be a non-abrasive pad without abrasive particles, such as Rodel OXB 3000 "Sycamore" polishing pad manufactured by Rodel Corporation. The Sycamore pad is a hard pad with trenches for macro-scale slurry transportation underneath the workpiece 131. The contact surface 144 can be a flat surface, or it can have a pattern of micro-features, trenches, and/or other features.

Referring still to FIG. 2, the dispenser 160 is configured to discharge the planarizing solution 150 onto a plurality of separate locations of the pad 140. In this embodiment, the dispenser 160 includes a support 162 over a portion of the pad 140 and a fluid discharge unit or distributor 164 (shown schematically) carried by the support 162. The support 162 can be an elongated arm that is attached to an actuator 166 that moves the support 162 relative to the pad 140. The distributor 164 can discharge a flow of the planarizing solution 150 onto the contact surface 144 of the pad 140. The distributor 164, for example, can be an elongated slot or a plurality of other openings extending along a bottom portion of the support 162. In this embodiment, the distributor 164 creates an elongated flow of planarizing solution 150 that simultaneously contacts an elongated portion of the contact surface 144 of the pad 140. The dispenser 160 accordingly discharges the planarizing solution onto a plurality of separate points or areas of the contact surface 144.

Figure 3A:
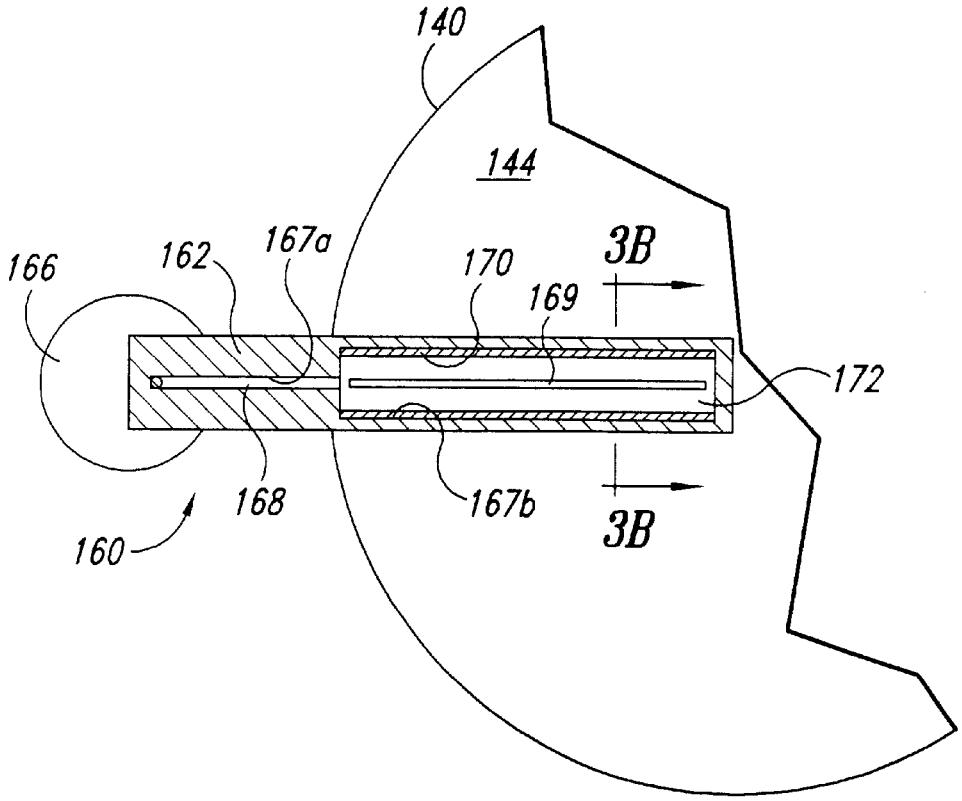
FIGS. 3A–3C are cross-sectional views showing an embodiment of a planarizing solution dispenser in accordance with the invention.

FIG. 3A is a top cross-sectional view showing the embodiment of the dispenser 160 of FIG. 2 along line 3A—3A. In this embodiment, the support 162 has a fluid passageway 168 for receiving the planarizing solution from a reservoir (not shown in FIG. 3A). The fluid passageway 168 can have a proximal section 167*a* through which the planarizing solution flows into the support and distal section 167*b* defining a cavity over the processing pad 140. The distributor 164 in this embodiment can have an elongated slot 169 along the bottom of the support 162 and a valve 170 within the distal section 167*b* of the fluid passageway 168. The valve 170 has a cavity 172, and the planarizing fluid can flow through the proximal section 167*a* and into the cavity 172 of the valve 170. The valve 170 operates to open and close the elongated slot 169 for controlling the flow of planarizing solution onto the contact surface 144.

Figure 3B:
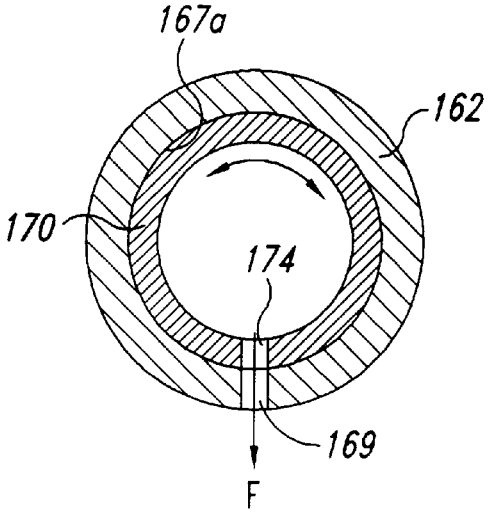
Figure 3C:
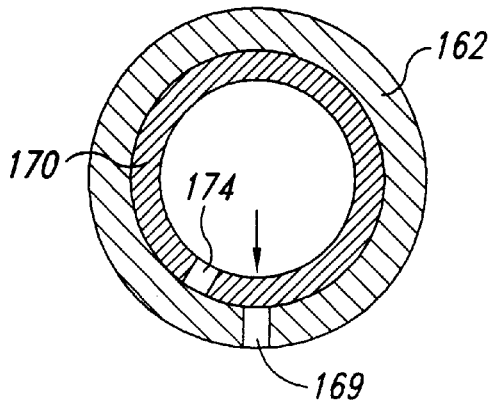

FIGS. 3B and 3C are cross-sectional views of the dispenser 160 taken along line 3B—3B shown in FIG. 3A. Referring to FIG. 3B, the valve 170 can fit within the distal section 167*b* so that an outer wall of the valve 170 engages or otherwise faces an inner wall of the distal section 167*b*. The valve 170 can have an elongated slot 174 or a plurality of holes extending along a portion of the valve. FIG. 3B illustrates the valve 170 in an open position in which the slot 174 in the valve 170 is at least partially aligned with the elongated slot 169 in so that a fluid F can flow through the slot 169. FIG. 3C illustrates the valve 170 in a closed position in which the slot 174 is not aligned with the elongated slot so that the valve 170 prevents the planarizing solution from flowing through the distributor 164. In operation, a motor or other actuator (not shown) can rotate the valve 170 within the arm 162 to open and close the slot 169.

Several embodiments of the planarizing machine 100 shown in FIG. 2 are expected to provide better planarizing results because the dispenser 160 is expected to provide a uniform coating of planarizing solution 150 across the contact surface 144 of the pad 140. By discharging the planarizing solution 150 along an elongated line across the pad 140, the planarizing solution 150 is deposited onto a plurality of separate areas of the contact surface 144. As the pad 140 rotates, the centrifugal force drives planarizing solution 150 off the perimeter of the pad. The wide coverage of the discharge area for the planarizing solution 150 and the spinning motion of the pad 140 act together to provide a distribution of planarizing solution across the pad 140 that is expected to have a uniform thickness. As a result, several embodiments of the planarizing machine 100 are expected to provide more uniform pad wear and temperature distribution across the contact surface 144 of the pad 140. Therefore, several embodiments of the planarizing machine 100 are expected to provide consistent planarizing results by reducing variances in planarizing parameters caused by a non-uniform distribution of planarizing solution.

Figure 4:
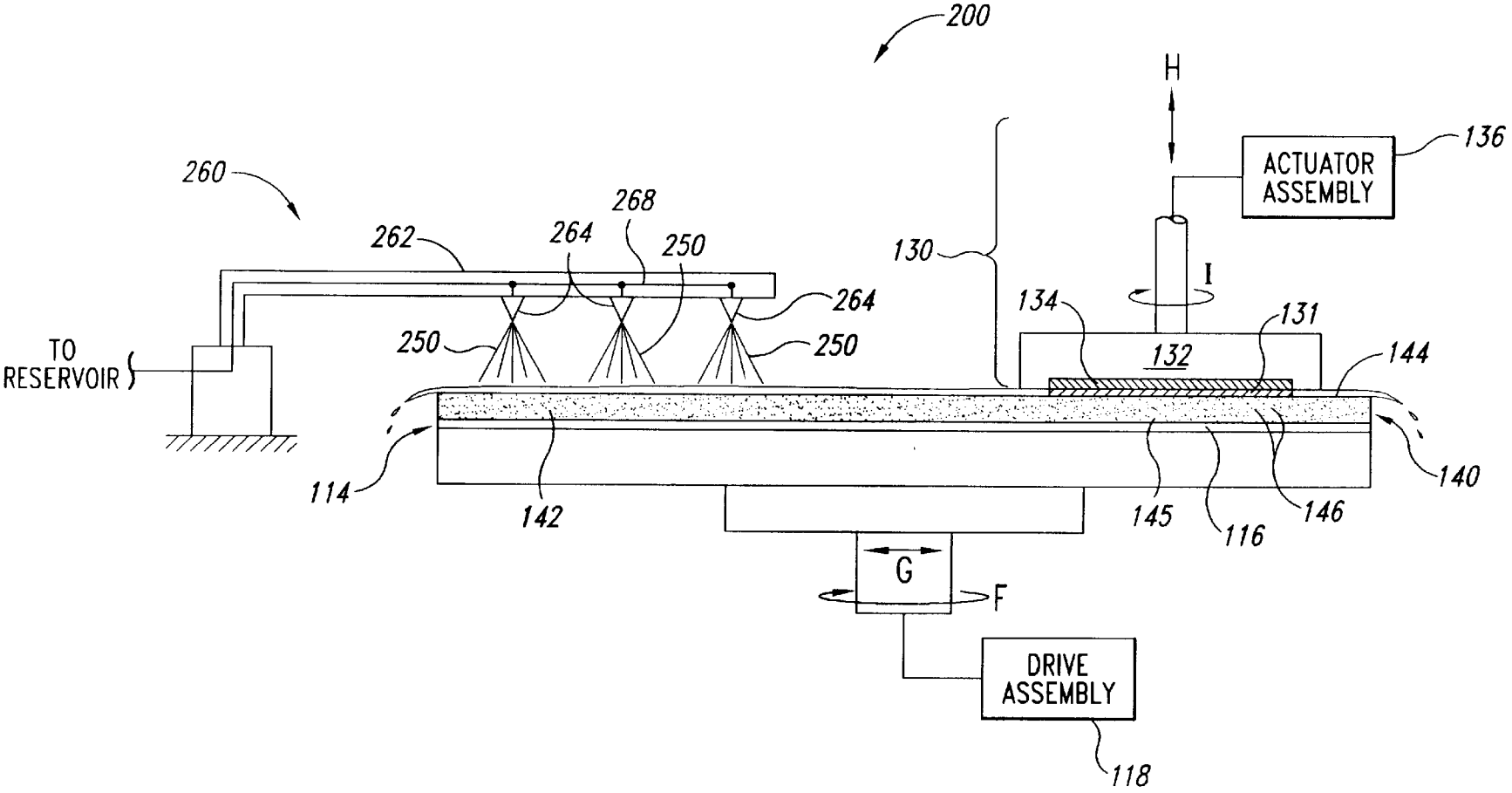
FIG. 4 is a side elevation view of a planarizing system including a planarizing solution dispenser in accordance with another embodiment of the invention with selected components shown in cross-section or schematically.
Figure 5:
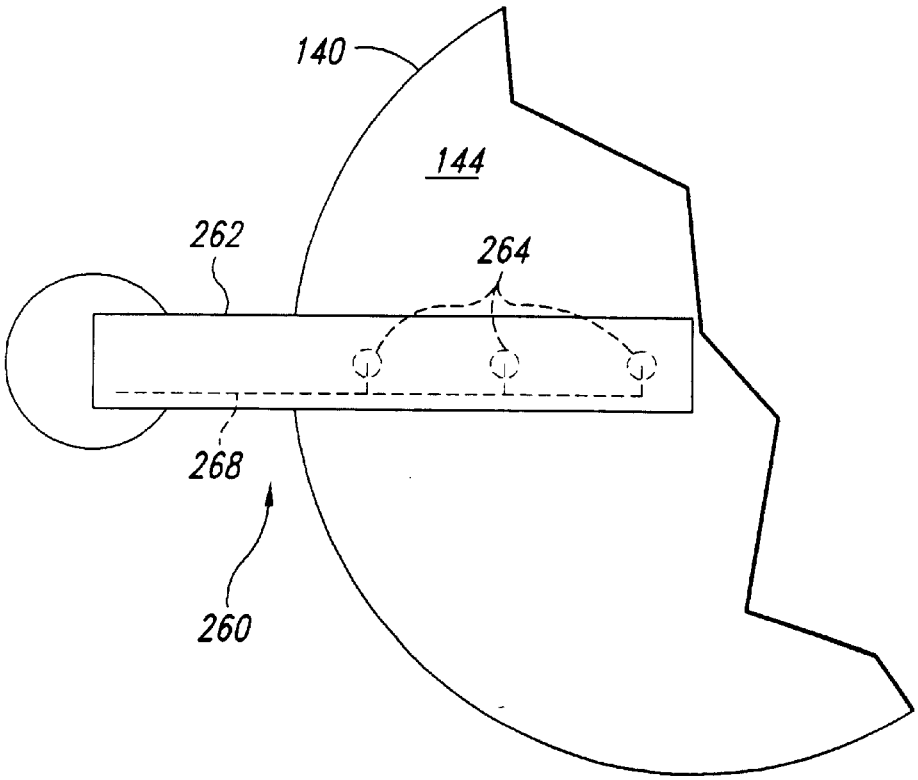
FIG. 5 is a top plan view of the planarizing system of FIG. 4.

FIGS. 4 and 5 illustrate the planarizing machine 200 having a solution dispenser 260 in accordance with another embodiment of the invention. The table 114, the drive assembly 118 and the carrier assembly 130 can be similar to those described above with reference to FIG. 2, and thus like reference numbers refer to like components in FIGS. 2–5. In this embodiment, the dispenser 260 includes a support 262 and a plurality of nozzles 264 carried by the support 262. The nozzles 264 are in fluid communication with a fluid passageway 268 that is also carried by the support 262. The nozzles 264 can be configured to produce gentle, low-velocity flows of planarizing solution 250. In operation, the planarizing solution 250 is pumped through the fluid passageway 268 and through the nozzles 264. The nozzles 264 accordingly define a distributor that discharges the planarizing solution 250 onto a plurality of locations of the pad 140. The planarizing machine 200 is expected to have several of the same advantages as the planarizing machine 100 described above.

Figure 7:
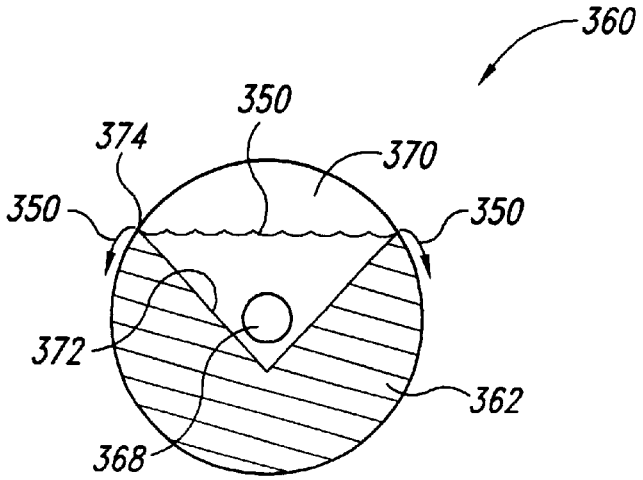
FIG. 7 is a front cross-sectional view of a portion of the planarizing solution dispenser of FIG. 6.
Figure 6:
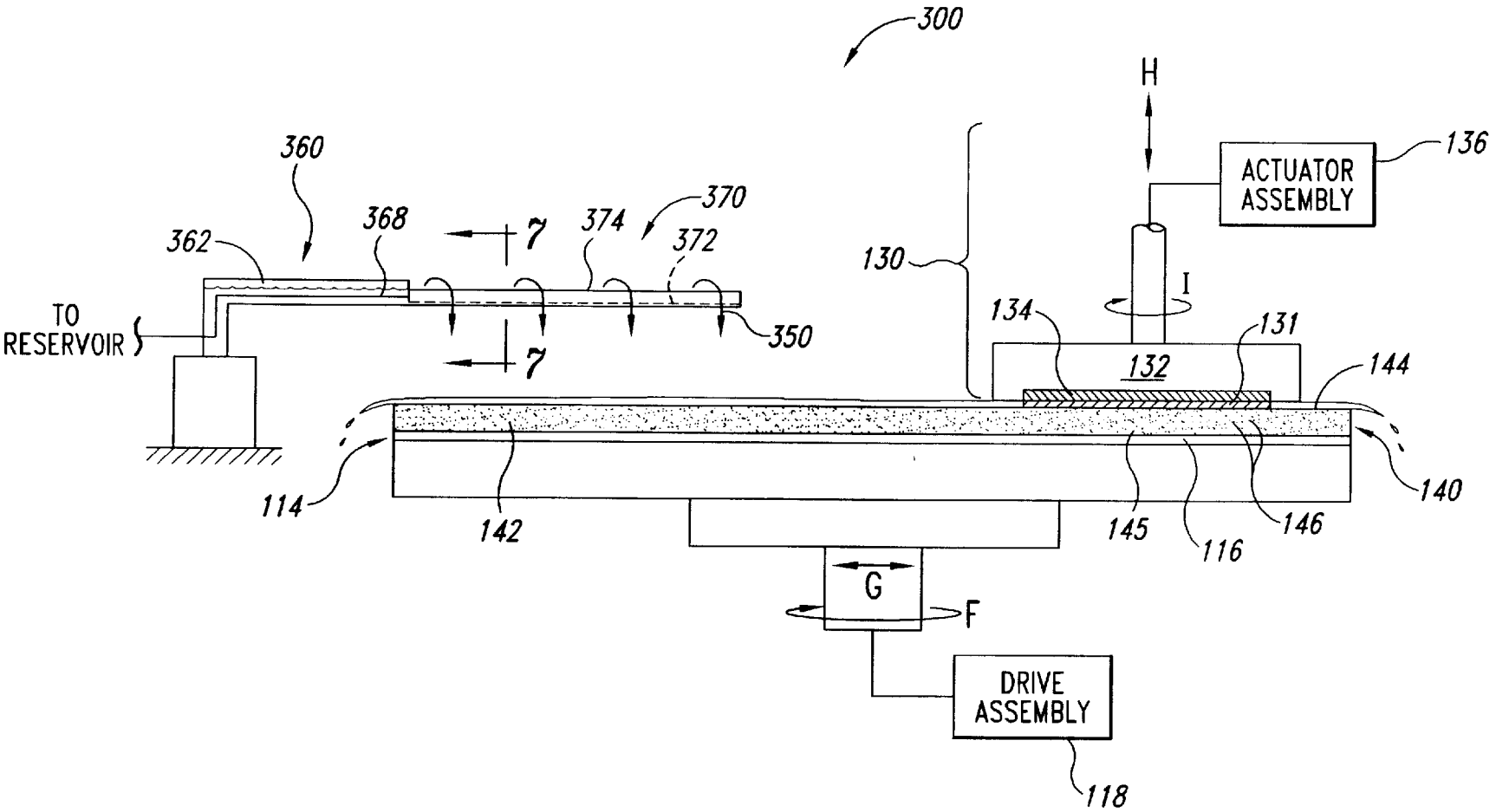
FIG. 6 is a side elevation view of a planarizing system including a planarizing solution dispenser in accordance with an embodiment of the invention with selected components shown in cross-section or schematically.

FIGS. 6 and 7 show a dispenser 360 in accordance with another embodiment of the invention for use with a planarizing machine 300. Referring to FIG. 6, the dispenser 360 has a support 362 with a fluid passageway 368 that extends into a weir 370. FIG. 7 is a cross-sectional view of the support 362 taken along line 7—7 of FIG. 6. Referring to FIG. 7, the weir 370 includes a channel or trough 372 that is in fluid communication with the fluid passageway 368 and a lip 374 at the top of the trough 372. In operation, a planarizing fluid 350 flows through the fluid passageway 368 and fills the trough 372 until the planarizing solution 350 flows over the lip 374. As shown in FIG. 6, the dispenser 360 discharges the planarizing solution 350 onto a plurality of separate locations of the contact surface 144. Several embodiments of the dispenser 360 are expected to operate in a manner similar to the dispensers 160 and 260 explained above.

Figure 8:
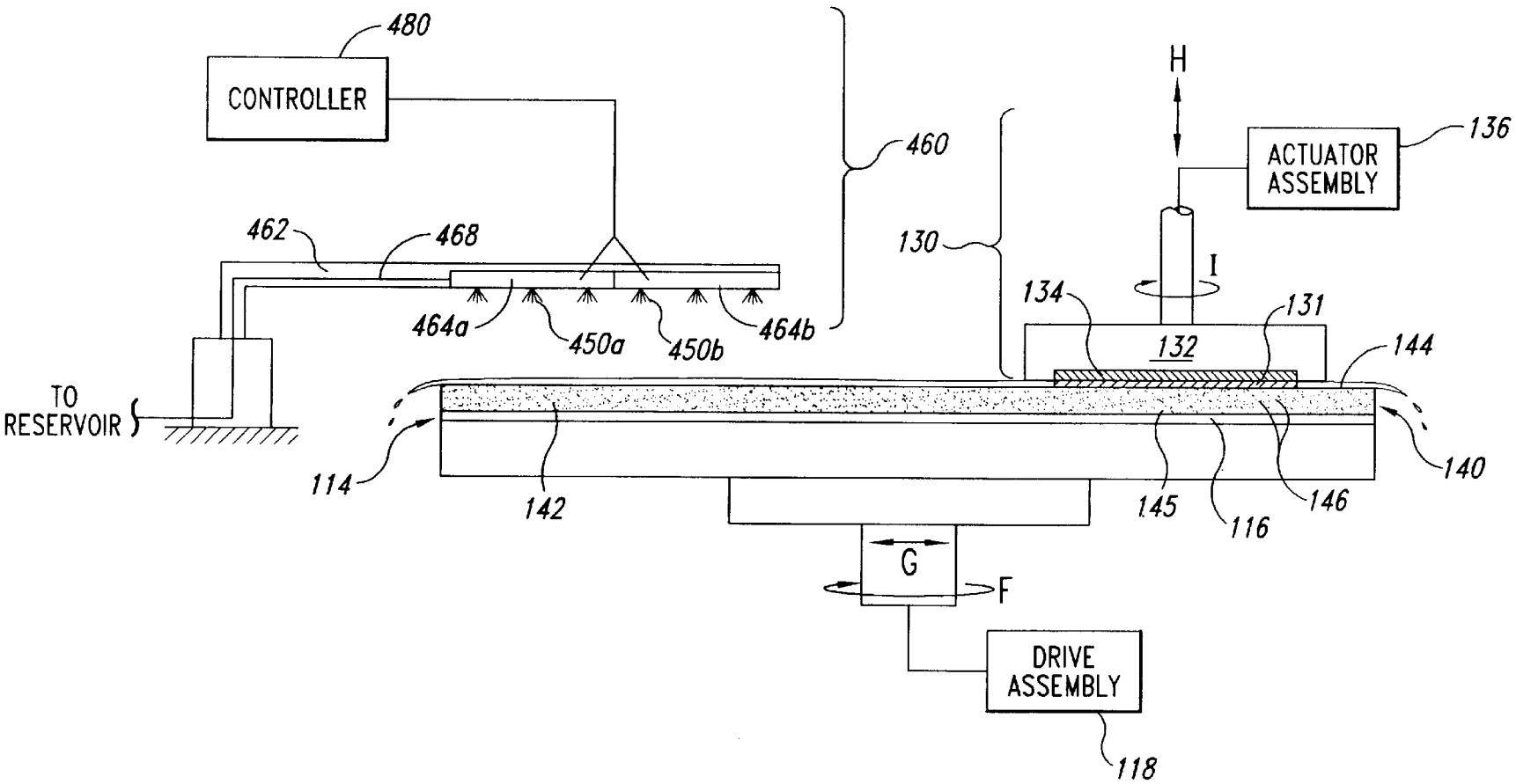
FIG. 8 is a side elevation view of a planarizing system including a planarizing solution dispenser in accordance with an embodiment of the invention with selected components shown in cross-section or schematically.

FIG. 8 shows a planarizing machine 400 having a distributor 460 in accordance with another embodiment of the invention. In this embodiment, the distributor 460 includes a support 462, a first fluid discharge unit 464*a* carried by a first section of the support 462, and a second fluid discharge unit 464*b* carried by a second section of the support 462. The dispenser 460 can further include a fluid passageway 468 coupled to each of the first and second discharge units 464*a* and 464*b*. The dispenser 460 also includes a controller 480 coupled to the fluid passageway 468 and/or each of the first and second fluid discharge units 464*a* and 464*b*.

In operation, the controller 480 independently controls the flow of the planarizing solution to the first and second fluid discharge units 464*a* and 464*b*. The first fluid discharge unit 464*a* can accordingly discharge a first flow of planarizing fluid 450*a*, and the second fluid discharge unit 464*b* can discharge a second flow of planarizing fluid 450*b*. The controller 480 can vary the first and second flows 450*a* and 450*b* of planarizing solution so that the planarizing solution is discharged onto the contact surface 144 in a manner that provides a desired distribution of the planarizing solution across the pad 140. For example, if the temperature at the perimeter portion of the processing pad 140 is greater than the central portion, then the first fluid flow 450*a* can be increased and/or the second fluid flow 450*b* can be decreased so that more planarizing solution is deposited onto the perimeter portion of the processing pad 140 relative to the central portion to dissipate more heat from perimeter portion of the pad 140. The controller 480 can be a computer, and each of the fluid discharge units 464*a* and 464*b* can be separate nozzles, slots, weirs, or other structures that can independently discharge separate fluid flows onto the pad 140.

Several embodiments of the planarizing machine 400 are expected to provide good control of planarizing parameters. By independently discharging separate fluid flows onto the pad 140, the distributor 460 and the controller 480 can be manipulated to change the distribution of the planarizing solution across the surface of the pad according to the actual planarizing results or parameters that are measured during a planarizing cycle. As such, the planarizing machine can create a desired nonuniform distribution of planarizing solution across the pad 140 to compensate for variances in other planarizing parameters. Therefore, several embodiments of the planarizing machine 400 are expected to provide additional control of the planarizing parameters to consistently produce high-quality planarized surfaces.

Figure 9:
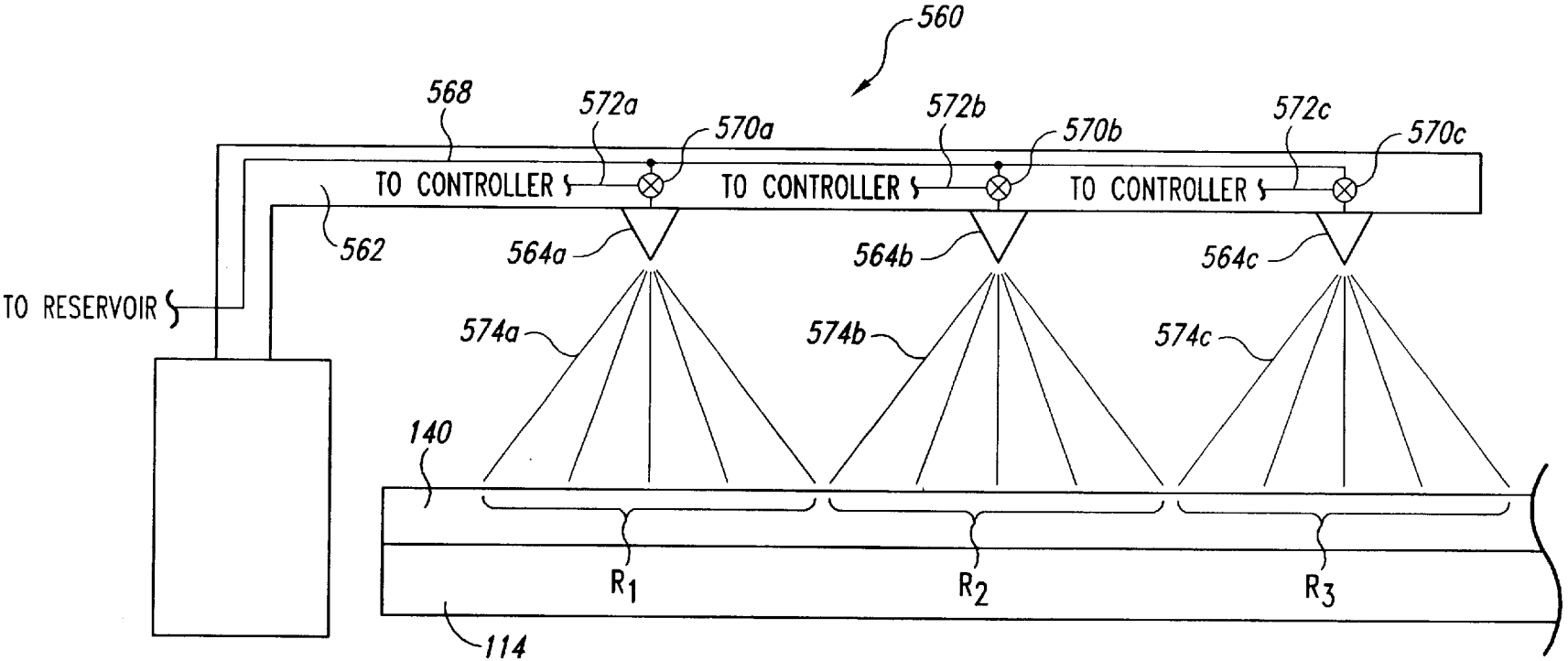
FIG. 9 is a side elevation view of an embodiment of a planarizing solution dispenser in accordance with the embodiment of FIG. 8.

FIG. 9 illustrates a dispenser 560 in accordance with another embodiment of the invention that can be used with the controller 480 of FIG. 8. In this embodiment, the dispenser 560 includes a support 562 extending over the pad 140 and a plurality of nozzles 564 (identified individually be reference numbers 564*a–c*) carried by the support 562. The support 562 can be an arm that is attached to an actuator or a fixed support relative to the pad 140. The nozzles 564 can include at least a first nozzle 564*a* defining a first fluid discharge unit and a second nozzle 564*b* defining a second fluid discharge unit. The nozzles 564 can also include a third nozzle 564*c* defining a third fluid discharge unit or any other suitable number of nozzles. The dispenser 560 also includes a fluid passageway 568 and a plurality of control valves 570 (identified individually by reference numbers 570*a–c*) coupled between the fluid passageway 568 and the nozzles 564. In this embodiment, the control valves include a first control valve 570*a* coupled to the first nozzle 564*a*, a second control valve 570*b* coupled to the second nozzle 564*b*, and a third control valve 570*c* coupled to the third nozzle 564*c*. The control valves 570 can be solenoid valves that are operatively coupled to the controller (not shown in FIG. 9) by signal lines 572*a–c*.

In operation, a planarizing solution flows through the fluid passageway 568 to the control valves 570, and the controller adjusts the control valves 570 to provide a plurality of separate planarizing solution flows 574*a–c* from the nozzles 564*a–c*. The controller can adjust the control valves according to real-time input from sensors during the planarizing cycles of the workpieces and/or from data based upon previous planarizing cycles. This allows the nozzles 564*a–c* to independently discharge the planarizing solution flows 574*a–c* onto separate regions $R_1$–$R_3$ across the pad 140 to compensate for nonuniformities in planarizing parameters across the pad 140. For example, if region $R_1$ requires less planarizing solution than region $R_2$, then the controller can send a signal to the first control valve 570*a* to reduce the first planarizing solution flow 574*a* from the first nozzle 564*a*. This is only an example, and it will be appreciated that many different combinations of flows can be configured by selecting the desired flow rates through the control valves 570.

Figure 10:
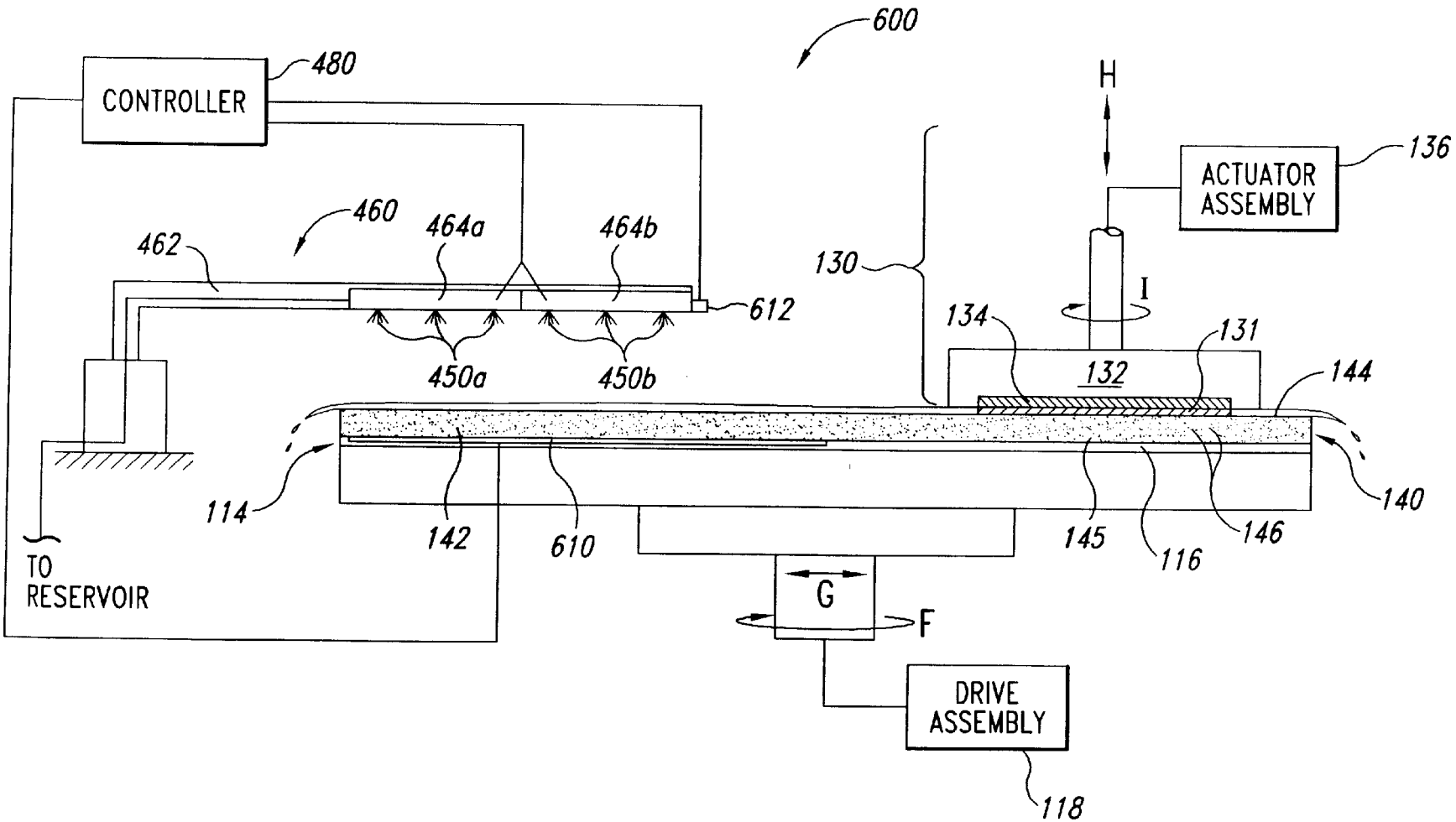
FIG. 10 is a side elevation view of a planarizing system including a planarizing solution dispenser in accordance with an embodiment of the invention with selected components shown in cross-section or schematically.

FIG. 10 shows a planarizing machine 600 in accordance with another embodiment of the invention. The planarizing machine 600 can have several components that are similar to the planarizing machine 400 shown in FIG. 8, and thus like reference numbers refer to like components in FIGS. 8 and 10. Additionally, the dispenser 460 in FIG. 10 can be similar to the dispenser 560 of FIG. 9. The planarizing machine 600 also includes a sensor assembly 610 that senses a planarizing parameter relative to areas or regions on the contact surface 144 of the pad 140. The sensor assembly 610 can be embedded in the pad 140, between the pad 140 and the support surface 116, and/or embedded in the support surface 116 of the table 114. The sensor assembly 610 can include temperature sensors that sense the temperature at the contact surface 144, and/or drag force sensors between the workpiece 131 and the contact surface 144. Suitable sensor assemblies are disclosed in U.S. Pat. Nos. 6,207,764; 6,046,111; 5,036,015; and 5,069,602; and U.S. application Ser. Nos. 09/386,684 and 09/387,309, all of which are herein incorporated by reference. In an alternate embodiment, the sensor assembly can be a sensor 612 positioned above the pad 140. The sensor 612 can be an infrared sensor to measure the temperature gradient across the contact surface, or the sensor 612 can be an optical sensor for sensing another type of parameter. The sensor assembly 610 and the sensor 612 can be coupled to the controller 480 to provide feedback signals of the sensed planarizing parameter.

In the operation of the planarizing machine 600, the sensor assembly 610 senses the planarizing parameter (i.e., temperature, pressure and/or drag force) and sends a corresponding signal to the controller 480. The sensor assembly 610, for example, can sense the differences in the planarizing parameter across the contact surface 144 and send signals to the controller 480 corresponding to a distribution of the planarizing parameter across the contact surface 144. The controller 480 then sends command signals to the fluid discharge units 464*a* and 464*b* according to the sensed planarizing parameters to independently adjust the flow rates of the planarizing solution flows 450*a* and 450*b* in a manner that brings or maintains the planarizing parameter within a desired range.

Figure 11:
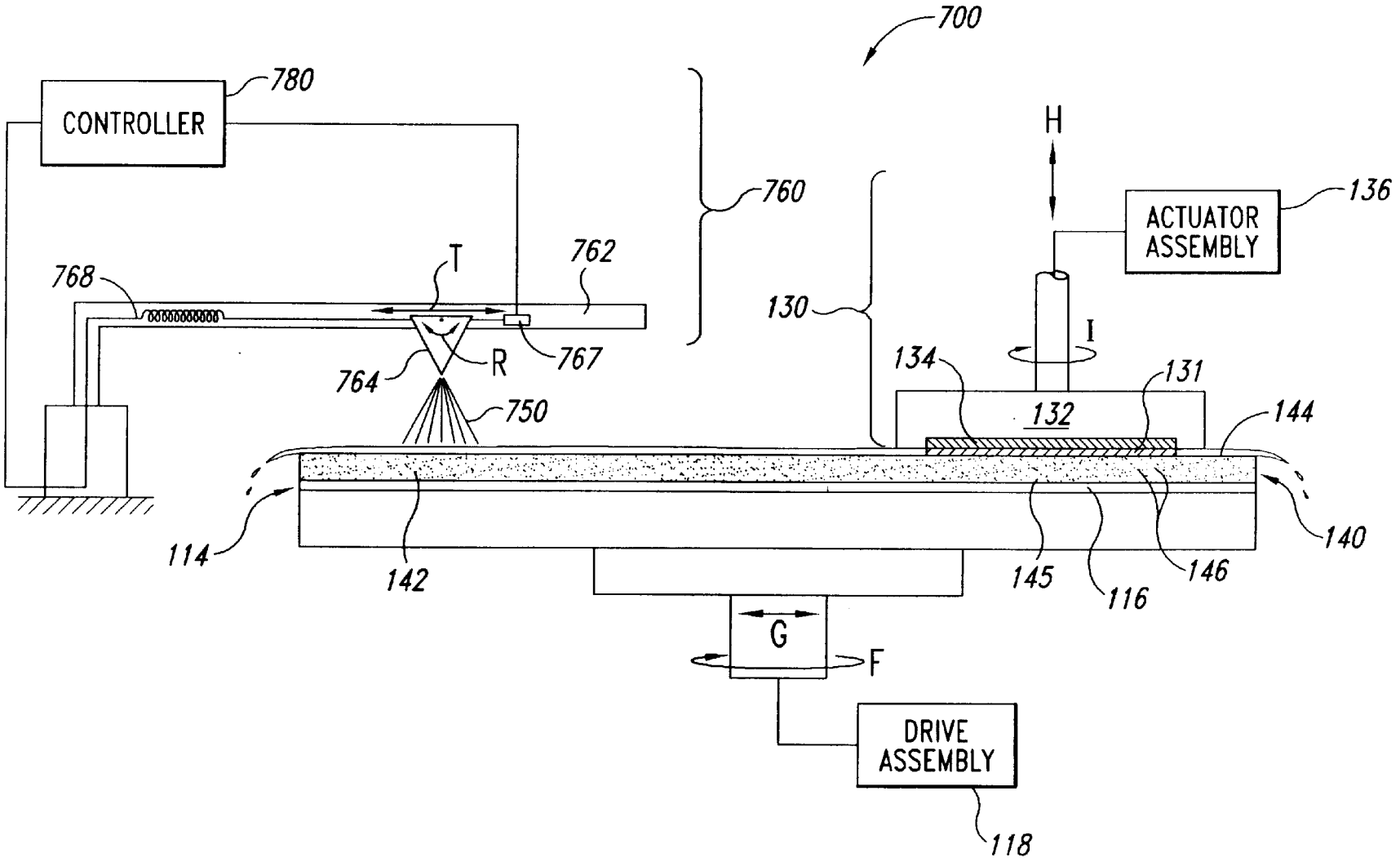
FIG. 11 is a side elevation view of a planarizing system including a planarizing solution dispenser in accordance with an embodiment of the invention with selected components shown in cross-section or schematically.

FIG. 11 shows a planarizing machine 700 having a distributor 760 and a controller 780 coupled to the distributor 760 in accordance with another embodiment of the present invention. In this embodiment, the distributor 760 includes a support 762 and a fluid discharge unit 764 moveably coupled to the support 762. The fluid discharge unit 764 can be slidably coupled to the support 762 to translate along the length of the support 762 (indicated by arrow T). In an alternate embodiment, the fluid discharge unit 764 can be rotatably carried by the support 762 (arrow R). The dispenser 760 can further include an actuator 767 coupled to the fluid discharge unit 764, and the support 762 can be a track along which the fluid discharge unit 764 can translate. The actuator 767 can be a servomotor or a linear actuator that drives the fluid discharge unit 764 along the support 762. The actuator 767 can also rotate the fluid discharge unit 764 relative to the support 762 in lieu of, or in addition to, translating the fluid discharge unit 764 along the support 762. The dispenser 760 can also include a fluid passageway 768 coupled to the fluid discharge unit 764. The fluid passageway 768 can be a flexible hose that coils up or elongates according to the movement of the fluid discharge unit 764 along the support 762.

The controller 780 is coupled to the actuator 767 to control the motion of the fluid discharge unit 764 relative to the support 762. The controller 780 can send command signals to the actuator 767 to increase or decrease the velocity of the relative motion between the fluid discharge unit 764 and the arm 762 to adjust the volume of planarizing solution deposited onto different areas of the surface 144 of the pad 140. This embodiment allows a single flow of planarizing solution 750 to have different flow characteristics according to the desired distribution of planarizing solution across the contact surface 144.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

What is claimed is:

1. A planarizing machine, comprising:

a table having a support surface;

a processing pad on the support surface;

a carrier assembly having a head configured to hold a microelectronic workpiece and a drive assembly carrying the head relative to the support surface; and a solution dispenser separate from the head, the solution dispenser being configured to discharge a planarizing solution onto a plurality of locations on the pad, the solution dispenser including an elongated support extending over the pad at a location spaced apart from a travel path of the head, the support having a first section and a second section;

a fluid passageway carried by the support through which the planarizing solution can flow;

a first fluid discharge unit at the first section of the support, the first discharge unit being configured to discharge a first flow of the planarizing solution onto a first location of the pad; and a second fluid discharge unit at the second section of the support, the second discharge unit being configured to discharge a second flow of the planarizing solution onto a second location of the pad, wherein the first and second fluid discharge units are independently controllable from one another.

2. A planarizing machine, comprising:

a table having a support surface;

a processing pad on the support surface;

a carrier assembly having a head configured to hold a microelectronic workpiece and a drive assembly carrying the head relative to the support surface; and a solution dispenser separate from the head, the solution dispenser being configured to discharge a planarizing solution onto a plurality of locations on the pad, the solution dispenser including an elongated support extending over the pad at a location spaced apart from a travel path of the head, the support having a first section and a second section;

a fluid passageway carried by the support through which the planarizing solution can flow;

a first nozzle at the first section of the support, the first nozzle being in fluid communication with the fluid passageway to discharge a first flow of the planarizing solution onto a first location of the pad; and a second nozzle at the second section of the support, the second nozzle being in fluid communication with the fluid passageway to discharge a second flow of the planarizing solution onto a second location of the pad, wherein the first and second fluid discharge units are independently controllable from one another.

3. A planarizing machine, comprising:

a table having a support surface;

a processing pad on the support surface;

a carrier assembly having a head configured to hold a microelectronic workpiece and a drive assembly carrying the head; and a solution dispenser separate from the head, the solution dispenser having a support extending over the pad and a distributor carried by the support, the support including an elongated arm and a fluid passageway carried by the arm through which the planarizing solution can flow, the arm having a first section and a second section, and the distributor being configured to discharge a planarizing solution from a plurality of locations alone the support, wherein the distributor further comprises a first fluid discharge unit at the first section and a second fluid discharge unit at the second section, the first discharge unit being configured to discharge a first flow of the planarizing solution onto a first location of the pad, and the second discharge unit being configured to discharge a second flow of the planarizing solution onto a second location of the pad, wherein the first and second fluid discharge units are independently controllable from one another.

4. A planarizing machine, comprising:

a table having a support surface;

a processing pad on the support surface;

a carrier assembly having a head configured to hold a microelectronic workpiece and a drive assembly carrying the head; and a solution dispenser separate from the head, the solution dispenser having a support extending over the pad and a distributor carried by the support, the support including an elongated arm and a fluid passageway carried by the arm through which the planarizing solution can flow, the arm a first section and a second section, and the distributor being configured to discharge a planarizing solution from a plurality of locations along the support, wherein the distributor further comprises a first nozzle at the first section and a second nozzle at the second section, the first nozzle being in fluid communication with the fluid passageway to discharge a first flow of the planarizing solution onto a first location of the pad, and the second nozzle being in fluid communication with the fluid passageway to discharge a second flow of the planarizing solution onto a second location of the pad, wherein the first and second fluid discharge units are independently controllable from one another.

5. A planarizing machine, comprising:

a table having a support surface;

a processing pad on the support surface;

a carrier assembly having a head configured to hold a microelectronic workpiece and a drive assembly carrying the head; and a solution dispenser separate from the head, the dispenser having a support above the pad and a plurality of nozzles carried by the support, the support including an elongated arm and a fluid passageway carried by the arm through which the planarizing solution can flow, the arm having a first section and a second section, and the nozzles being coupleable to the planarizing solution, wherein the dispenser further comprises a first nozzle at the first section and a second nozzle at the second section, the first nozzle being in fluid communication with the fluid passageway to discharge a first flow of the planarizing solution onto a first location of the pad, and the second nozzle being in fluid communication with the fluid passageway to discharge a second flow of the planarizing solution onto a second location of the pad, wherein the first and second fluid discharge units are independently controllable from one another.

6. A planarizing machine, comprising:

a table having a support surface;

a processing pad on the support surface;

a carrier assembly having a head configured to hold a microelectronic workpiece and a drive assembly carrying the head;

a solution dispenser having a first fluid discharge unit over a first area of the pad and a second fluid discharge unit over a second area of the pad spaced apart from the first area, the first and second discharge units having independently controllable flow rates of a planarizing solution; and a controller coupled to the solution dispenser, the controller selecting a first flow rate of planarizing solution for the first discharge unit and a second flow rate of planarizing solution for the second discharge unit.

7. The planarizing machine of claim 6 wherein:

the support comprises an elongated arm and a fluid passageway carried by the arm through which a planarizing solution can flow; and the first discharge unit being configured to discharge a first flow of the planarizing solution onto a first location of the pad, and the second discharge unit being configured to discharge a second flow of the planarizing solution onto a second location of the pad, wherein the first and second fluid discharge units are independently controllable from one another.

8. The planarizing machine of claim 6 wherein:

the support comprises an elongated arm and a fluid passageway carried by the arm through which a planarizing solution can flow; and the first fluid discharge unit comprises a first nozzle and the second fluid discharge unit comprises a second nozzle, the first nozzle being in fluid communication with the fluid passageway to discharge a first flow of the planarizing solution onto a first location of the pad, and the second nozzle being in fluid communication with the fluid passageway to discharge a second flow of the planarizing solution onto a second location of the pad, wherein the first and second fluid discharge units are independently controllable from one another.

9. A method of processing a microelectronic workpiece, comprising:

removing material from the workpiece by pressing the workpiece against a contact surface of a processing pad and imparting relative motion between the workpiece and the contact surface;

depositing a planarizing solution from a dispenser directly onto the contact surface, wherein the dispenser comprises a support, a first discharge unit at a first section of the support, and a second discharge unit at a second section of the support, and wherein depositing the planarizing solution comprises discharging planarizing solution through the first and second discharge units, the first discharge unit discharging a first flow of planarizing solution directly onto a first region of the contact surface, and the second discharge unit discharging a second flow of planarizing solution directly onto a second region of the contact surface separate from the first region.

10. The method of claim 9 wherein:

the first discharge unit discharge the first flow at a first flow rate and the second discharge unit discharges the second flow at a second flow rate different than the first flow rate.

11. The method of claim 9 wherein:

depositing the flow of the planarizing solution comprises discharging planarizing solution through a first nozzle and a second nozzle, the first nozzle discharging the first flow at a first flow rate and the second nozzle discharging the second flow at a second flow rate; and controlling the first and second flow rates independently from one another.

12. The method of claim 9, further comprising controlling the first flow independently from the second flow.

13. A method of processing a microelectronic workpiece, comprising:

removing material from the workpiece by pressing the workpiece against a contact surface of a processing pad and imparting relative motion between the workpiece and the contact surface; and discharging a planarizing solution directly onto a first region of the contact surface and concurrently discharging the planarizing solution directly onto a second region of the contact surface separate from the first region, the planarizing solution being deposited onto the first and second regions separate from a head carrying the workpiece, wherein discharging planarizing solution onto the pad comprises discharging planarizing solution through first and second discharge units, the first discharge unit discharging a first flow at a first flow rate and the second discharge unit discharging a second flow at a second flow rate different than the first flow rate.

14. The method of claim 13, further comprising controlling the first and second flow rates independently of each other.

15. The method of claim 13, further comprising:

sensing a processing parameter associated with removing material from the workpiece; and controlling the first and second flow rates independently from each other according to the sensed processing parameter.

16. The planarizing machine of claim 1 wherein the first and second fluid discharge units are slidably carried by the support and in fluid communication with the fluid passageway, the first and second fluid discharge units being independently moveable along the support to discharge a flow of the planarizing solution onto separate areas of the processing pad.

17. The planarizing machine of claim 1 wherein the first fluid discharge unit comprises a first nozzle rotatably coupled to the support and the second fluid discharge unit comprises a second nozzle rotatably coupled to the support, the first nozzle being in fluid communication with the fluid passageway to discharge a first flow of the planarizing solution onto a first location of the pad, and the second nozzle being in fluid communication with the fluid passageway to discharge a second flow of the planarizing solution onto a second location of the pad.

18. The planarizing machine of claim 1, further comprising:

a temperature sensor to sense a temperature of a contact surface of the processing pad;

a valve coupled to the flow of the planarizing solution; and a controller coupled to the temperature sensor and the valve, wherein the controller causes the valve to adjust the flow rate of the planarizing solution through the dispenser according to the temperature sensed by the temperature sensor.

19. The planarizing machine of claim 1, further comprising:

a pressure sensor to sense a pressure between the workpiece and a contact surface of the processing pad;

a valve coupled to the flow of the planarizing solution; and a controller coupled to the pressure sensor and the valve, wherein the controller causes the valve to adjust the flow rate of the planarizing solution through the dispenser according to the pressure sensed by the pressure sensor.

20. The planarizing machine of claim 1, further comprising:

a drag sensor to sense a drag force between the workpiece and a contact surface of the processing pad;

a valve coupled to the flow of the planarizing solution; and a controller coupled to the drag sensor and the valve, wherein the controller causes the valve to adjust the flow rate of the planarizing solution through the dispenser according to the drag force sensed by the drag sensor.

21. The planarizing machine of claim 1, further comprising:

a temperature sensor to sense a temperature of a contact surface of the processing pad;

a valve coupled to the flow of the planarizing solution; and a controller coupled to the temperature sensor and the valve, wherein the controller causes the valve to adjust the flow rate of the planarizing solution through the dispenser according to the temperature sensed by the temperature sensor.

22. The planarizing machine of claim 1, further comprising:

a pressure sensor to sense a pressure between the workpiece and a contact surface of the processing pad;

a valve coupled to the flow of the planarizing solution; and a controller coupled to the pressure sensor and the valve, wherein the controller causes the valve to adjust the flow rate of the planarizing solution through the dispenser according to the pressure sensed by the pressure sensor.

23. The planarizing machine of claim 3, further comprising:

a drag sensor to sense a drag force between the workpiece and a contact surface of the processing pad;

a valve coupled to the flow of the planarizing solution; and a controller coupled to the drag sensor and the valve, wherein the controller causes the valve to adjust the flow rate of the planarizing solution through the dispenser according to the drag force sensed by the drag sensor.

24. The planarizing machine of claim 5, further comprising:

a temperature sensor to sense a temperature of a contact surface of the processing pad;

a valve coupled to the flow of the planarizing solution; and a controller coupled to the temperature sensor and the valve, wherein the controller causes the valve to adjust the flow rate of the planarizing solution through the dispenser according to the temperature sensed by the temperature sensor.

25. The planarizing machine of claim 5, further comprising:

a pressure sensor to sense a pressure between the workpiece and a contact surface of the processing pad;

a valve coupled to the flow of the planarizing solution; and a controller coupled to the pressure sensor and the valve, wherein the controller causes the valve to adjust the flow rate of the planarizing solution through the dispenser according to the pressure sensed by the pressure sensor.

26. The planarizing machine of claim 5, further comprising:

a drag sensor to sense a drag force between the workpiece and a contact surface of the processing pad;

a valve coupled to the flow of the planarizing solution; and a controller coupled to the drag sensor and the valve, wherein the controller causes the valve to adjust the flow rate of the planarizing solution through the dispenser according to the drag force sensed by the drag sensor.

* * * * *

UNITED STATES PATENT AND TRADEMARK OFFICE

CERTIFICATE OF CORRECTION

PATENT NO. : 6,722,943 B2
DATED : April 20, 2004
INVENTOR(S) : Joslyn

It is certified that error appears in the above-identified patent and that said Letters Patent is hereby corrected as shown below:

Column 2,
Line 33, insert -- to be at -- between “solution” and “the”;

Column 3,
Line 40, insert -- the -- between “by” and “support”;

Column 5,
Line 37, insert -- extending -- between “162” and “over”;
Line 58, insert -- a -- between “and” and “distal”;

Column 6,
Line 10, insert -- the support 162 -- between “in” and “so”;
Line 13, insert -- 169 -- between “slot” and “so”;

Column 8,
Line 41, insert -- pressure sensors that sense localized forces exerted against the contact surface 144, -- between “144,” and “and/or”;

Column 9,
Line 30, insert -- contact -- between “the” and “surface”;

Column 10,
Line 42, “alone” should be -- along --;

Column 12,
Line 31, “discharge” should be -- discharges --.

Signed and Sealed this

Fifteenth Day of November, 2005

JON W. DUDAS
*Director of the United States Patent and Trademark Office*